United States Patent [19]

Palmaer

[11] Patent Number: 4,639,950

[45] Date of Patent: Feb. 3, 1987

[54] METHOD OF AND MEANS FOR HOLDING A SECURING MEMBER IN AN EXISTING ATTACHMENT SLIT

[76] Inventor: Leif Palmaer, Kristinagatan 14, Värnamo, Sweden

[21] Appl. No.: 667,412

[22] Filed: Nov. 1, 1984

[30] Foreign Application Priority Data

Nov. 30, 1983 [SE] Sweden ..... 8306589

[51] Int. Cl.[4] ..... A42B 1/24

[52] U.S. Cl. ..... 2/422; 2/209; 292/342; 403/374

[58] Field of Search ..... 2/422, 423, 209; 292/342; 179/156 R; 403/374, 409.1

[56] References Cited

U.S. PATENT DOCUMENTS

| | | | |
|---|---|---|---|
| 978,508 | 12/1910 | Sutherland et al. | 403/374 X |
| 1,183,767 | 5/1916 | Radtke | 403/374 X |
| 2,107,835 | 2/1938 | Pierce | 403/374 X |
| 2,205,614 | 6/1940 | Bashe | 292/342 |
| 2,989,326 | 6/1961 | Seward et al. | 403/374 X |
| 3,834,826 | 9/1974 | Simond | 403/374 |
| 4,282,665 | 8/1981 | Fletcher et al. | 403/374 X |

FOREIGN PATENT DOCUMENTS 8104021 6/1981 Sweden .

*Primary Examiner*—Werner H. Schroeder
*Assistant Examiner*—J. L. Olds
*Attorney, Agent, or Firm*—Ostrolenk, Faber, Gerb & Soffen

[57] ABSTRACT

A tongue or other insert part of a securing member for accessories such as ear muffs, is held in place in an attachment slit at the rim of a protective helmet by a substantially wedge-shaped locking adapter provided with barbs or saw-teeth engaging in recesses in the tongue of the securing member. The locking adaptor, together with tongue of the securing member, substantially fills the attachment slit, thus wedging the securing member in position. The barbs or saw-teeth may be formed on the tongue of the securing member and complementary recesses formed in the wedge-shaped adaptor.

7 Claims, 7 Drawing Figures

METHOD OF AND MEANS FOR HOLDING A SECURING MEMBER IN AN EXISTING ATTACHMENT SLIT

BACKGROUND OF THE INVENTION

The present invention relates to a method and means for holding a securing member in an attachment slit. The invention can be used with advantage in relation to protective headgear such as protective helmets already provided with attachment slits for securing members designed to carry accessories such as ear-muffs and the like.

Protective helmets and the like are often provided with an attachment slit on each side for securing accessories such as ear-muffs, a face-shield (visor), or a rain-shield. For reasons connected with manufacture, the attachment slit is constructed with downward release i.e. increases progressively in width to a small extent in a downward direction to facilitate downward removal, from the attachment slit, of the mould insert which forms the slit in manufacture.

The attachment slit is designed to receive a tongue or other insert part of a securing member which tongue or other insert part is introduced into the attachment slit from above. The securing member preferably carries accessories for the helmet, such as ear-muffs, visor, etc. The tongue or other insert part of the securing member is constructed with upward release i.e. increases progressively in width to a small extent in an upward direction to facilitate upward removal, from the mould in which the securing member is moulded, of the tongue or other insert part, said tongue or other insert part being however provided at its lower end with gripping claws designed to grip the lower edge of the formation which affords the attachment slit, thus firmly retaining the securing member in the attachment slit.

However, this conventional combination of attachment slit and securing member has not functioned satisfactorily. Particularly when several helmet accessories are to be retained, problems arise in anchoring the securing member in the attachment slit. The problem is of course intensified if the attachment slits vary in width, height and length from helmet to helmet for reasons to do with the manufacture. The problem is likewise pronounced in the case of helmets of soft material or having rounded lower edges which provide poor grip for the claws of the securing member and cause such claws to deform the lower edge of the helmet when under strain.

In order to solve these problems and to achieve a better fit between attachment slit and securing member, a range of different securing members of various dimensions has been used in the past. However, this has necessitated increased stocking, and has increased the cost of the product.

SUMMARY OF THE INVENTION

It is among the objects of the present invention to provide a method of and a means for simply and inexpensively holding a securing member in such an attachment slit. It is another object of the invention to provide a means for holding a securing member in such an attachement slit which is able to compensate for variations in dimension in the attachment slit and to allow a securing member to fit different helmet constructions, and which means allows a securing member to be used in different helmets of various different materials.

According to one aspect of the invention, there is provided a method of holding a securing member in an existing attachment slit, the securing member having a portion for introduction into said attachment slit, the method comprising providing a substantially wedge-shaped locking adaptor, providing the locking adaptor with at least one engagement element, providing a complementary engagement element on said portion of the securing member, introducing said portion of the securing element into said attachment slit, introducing the locking adaptor into said slit so that it engages said portion of the securing member and so that said engagement element of the locking adaptor co-operates with said complementary engagement element of said securing member while the locking adaptor, together with said portion of the securing member substantially fills the attachment slit, thus wedging the securing member in position in the attachment slit.

According to another aspect of the invention, there is provided a means for holding a securing member in an attachment slit, comprising a substantially wedge-shaped locking adaptor consisting of two transversely spaced longitudinal support beams and an intermediate part connecting said beams, and at least one engagement element on said intermediate part for co-operation with a complementary engagement element on such a securing member.

Within practical limits the locking adaptor can easily be adjusted to attachment slits of various dimensions. Stocking is thus limited to one size of securing member and one or a few sizes of locking adaptor.

According to a yet further aspect of the invention, there is provided the combination of an article of protective headgear having an attachment slit formed therein, an accessory securing member having a tongue inserted in said attachment slit, and a wedge-shaped locking adaptor also inserted into said attachment slit to hold said tongue in place, wherein said locking member is provided with a first engagement element and said tongue is provided with a second engagement element, said first and second engagement elements being complementary with one another and engaging one another, said locking adaptor and said tongue together substantially filling said slit, the locking adaptor exerting a wedging action preventing removal of said tongue from said attachment slit.

Preferred embodiments of the invention are described in detail below with reference to the accompanying drawings.

DESCRIPTION OF PREFERRED EMBODIMENTS

Figure 1:
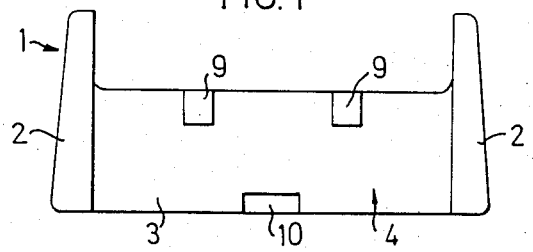
FIG. 1 shows an elevation view of a locking adaptor embodying the invention.
Figure 2:
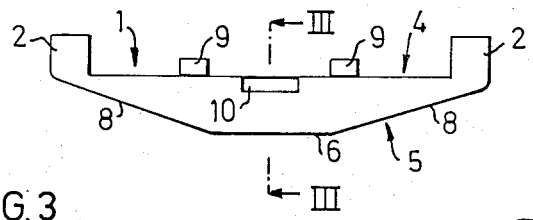
FIG. 2 shows an underneath plan view of the locking adaptor of FIG. 1.
Figure 3:
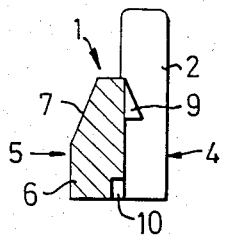
FIG. 3 is a view in section along the line III—III in FIG. 2.

FIGS. 1–3 show a locking adaptor 1, comprising two transversely spaced longitudinal support beams 2, joined by an intermediate part 3 having a substantially flat front surface 4. A central part 6 of the intermediate part 3, adjacent the lower edge of part 3, has a substantially uniform, relatively great thickness presenting a flat rear face parallel with the front surface 4. Extending upwardly from this central part to the upper edge of part 3 is a wedge-shaped bevelled upper part 7 tapering in thickness towards said upper edge. Similarly wedge-shaped side parts 8 extend from part 6 towards each of the respective support beams 2, each part 8 tapering in thickness towards the respective beam 2. On the front surface 4 the locking adaptor 1 is provided with one or more first engagement elements 9 and a recess 10. The flat rear face of central part 6, and the relatively inclined faces of upper part 2 and side parts 8 together form a rear surface 5.

As shown in FIG. 3 the engagement elements 9 are in the form of detents or barbs of saw-tooth form in section, tapering in an upward direction and each having a generally horizontal, downwardly facing flat abutment face.

Figure 5:
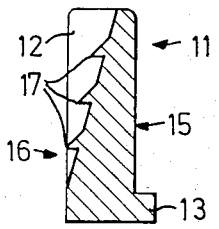
FIG. 5 shows a view in section along the line V—V in FIG. 4.
Figure 4:
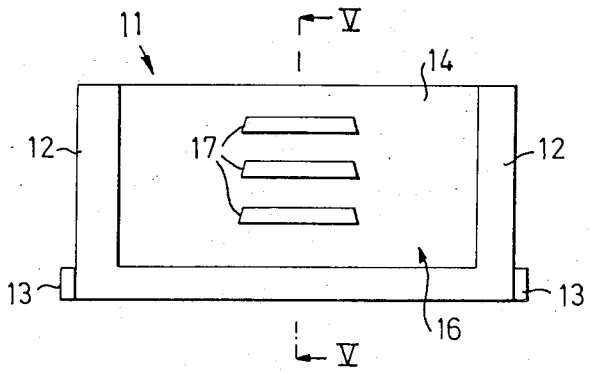
FIG. 4 shows an elevation view of an alternative form of a locking adaptor embodying the invention.

FIGS. 4 and 5 show an alternative embodiment of a locking adaptor 11, again comprising two transversely spaced longitudinal beams 12 joined by an intermediate part 14. The adaptor has a flat rear face 15 extending from its upper edge to a rectangular-section locking rib 13 at the lower edge of the adaptor. The intermediate part 14 has a front face 16 which is inclined relative to the rear face 15 so that the intermediate part 14 is wedge shaped, as best shown in section in FIG. 5, part 14 tapering in thickness towards the upper edge of the adaptor 11.

First engagement elements are provided in the form of short ribs 17 projecting from the face 16, the ribs 17 being of saw-tooth form, tapering upwardly, and providing at their lower extremities respective downwardly facing horizontal abutment faces, as best shown in FIG. 5.

Figure 6:
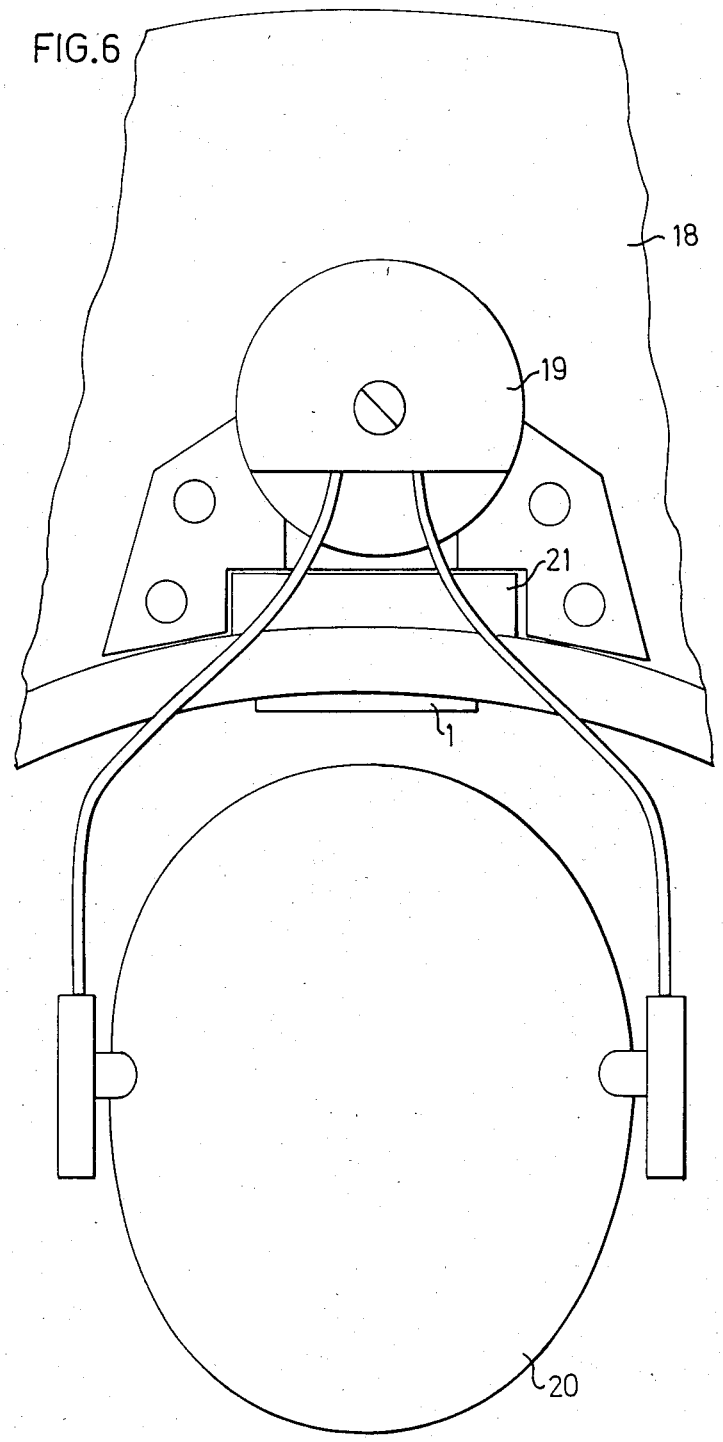
FIG. 6 shows a fragmentary elevation view illustrating part of a helmet provided with an attachment slit, a securing member engaged in the attachment slit and located by a locking adaptor, and an ear-muff supported by the securing member.
Figure 7:
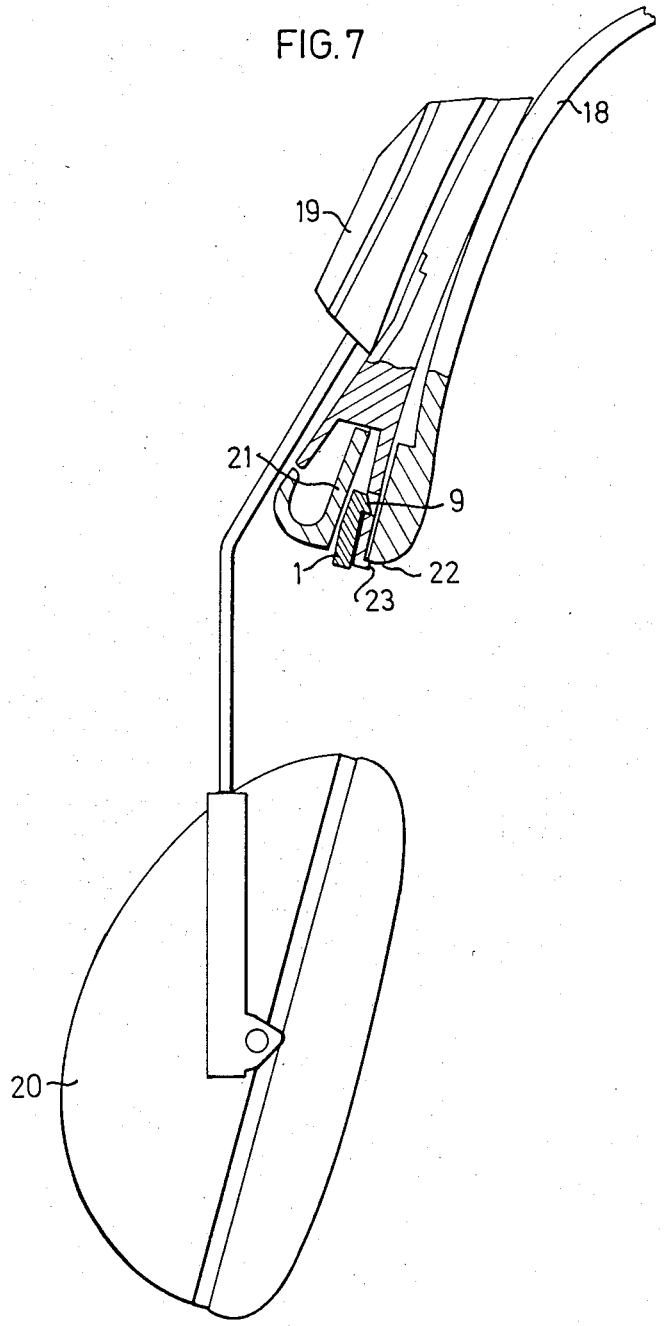
FIG. 7 shows, partially in section, a side view of the arrangement shown in FIG. 6.

FIGS. 6 and 7 show a protective helmet 18 with a securing member 19 supporting an ear-muff 20, the securing member 19 having a tongue or insert member fitted into an attachment slit. The attachment slit is formed between the helmet shell and a formation 21 at the rim of the helmet, formed integrally with the helmet shell. This tongue is held in place by wedging with a locking adaptor. The tongue has, at its lower end, claws 23 which extend over the lower edge 22 of the helmet shell at the open bottom of the attachment slit.

The securing member 19 is inserted from above into the attachment slit of the helmet 18 until the gripping claws 23 grip the lower edge 22 of the attachment slit. The locking adaptor 1 is then inserted from below into the attachment slit, so that a first engagement element 9 on the locking adaptor co-operates with a corresponding second engagement element, in the form of a slot or recess, in the tongue of the securing member 19, whereupon the locking adaptor 1, together with the tongue of the securing member 19, substantially fills the attachment slit and the tongue is wedged tightly in place.

Whilst, in FIGS. 1 and 3, barbs 9 are shown only adjacent the upper edge of the intermediate part 4 further barbs may be provided below the barbs shown, in a manner analagous to the construction of FIGS. 4 and 5.

The first engagement elements 9, 17 of the locking adaptor 1, 11 preferably consist of barbs or saw-teeth protruding from the adaptor and having well-defined lower edges for engagement in corresponding second engagement elements, said second elements preferably consisting of recesses in the tongue of the securing member 19. Alternatively, the first engagement elements 9, 17 may consist of recesses designed to receive corresponding second engagement elements in the form of barbs or saw-teeth on the tongue of the securing member. Furthermore, the second engagement elements whether in the form of teeth or of recesses may be arranged on one or other of the opposing surfaces of the attachment slit instead of, or in addition to, on the tongue of the securing members 18.

Since the attachment slit is made with a downward release, as herein defined, upward movement of the securing member 19 with locking adaptor 1 or 11 will result in an even tighter wedging of the tongue and adaptor in the attachment slit. If the attachment slit is provided with little release or with upward release, the locking adaptor may be provided with a longitudinal locking rib at its lower edge, such as that shown at 13 in FIGS. 4 and 5, which rib, when the tongue/adaptor combination is moved upwardly, presses against the lower edge of one or other of the helmet parts between which the attachment slit is defined.

By inserting a screw-driver or the like between the tongue of securing member 19 and the locking adaptor 1, 11, for example in the recess 10, at the lower edge of the adaptor 1, the engagement elements 9, 17 are disengaged and the tongue of the securing member 19 can be pulled out of the attachment slit.

The locking adaptor 1, 11 can easily be adapted to the width of various attachment slits by cutting material from the support beams 2, 12, and to the length of different attachment slits by breaking or cutting off a part of the intermediate section 3, 14.

The invention is naturally not limited to the examples shown in the drawings and may be varied within the scope of the following claims.

I claim:

1. A method of holding a securing member in an existing attachment slit, the securing member having a portion for introduction into said attachment slit, the method comprising providing a substantially wedge-shaped locking adaptor, providing the locking adaptor with at least one engagement element, providing a complementary engagement element on said portion of the securing member, introducing said portion of the securing element into said attachment slit, introducing the locking adaptor into said slit so that it engages said portion of the securing member and so that said engagement element of the locking adaptor co-operates with said complementary engagement element of said securing member while the locking adaptor, together with said portion of the securing member substantially fills the attachment slit, thus wedging the securing member in position in the attachment slit.

2. A means for holding a securing member having a complementary engagement element in an attachment slit, comprising a substantially wedge-shaped locking adaptor comprising two transversely spaced longitudinal support beams, an intermediate part connecting said beams, and at least one engagement element on said intermediate part for co-operation with said complementary engagement element of said securing member.

3. The means of claim 2, wherein said engagement element comprises a protruding ratchet tooth.

4. The means according to claim 2, wherein said intermediate part has a lower edge and an upper edge, a central part adjoining said lower edge, said central part being of substantially uniform thickness, the intermediate part tapering in thickness from said central part to said support beams and from said central part to said upper edge, said intermediate part being substantially flat on its front surface and having its rear surface contoured in conformity with said tapering.

5. The means of claim 2, further comprising a locking rib extending along said intermediate part, said intermediate part having an upper edge and a lower edge and a substantially flat rear surface and a front surface inclined relative to said rear surface whereby said intermediate part tapers like a wedge from said lower edge to said upper edge, and wherein said locking rib is disposed at said lower edge.

6. The means of claim 4, wherein said engagement element on the locking adaptor is located on the front surface of the locking adaptor.

7. The means of claim 5, wherein said engagement element on the locking adapator is located on the front surface of the locking adaptor.

* * * * *